United States Patent [19]

Everett

[11] Patent Number: 4,598,631

[45] Date of Patent: Jul. 8, 1986

[54] INDOOR GUN FIRING RANGE ENCLOSURE

[76] Inventor: Robert W. Everett, 3523 Leith La., Louisville, Ky. 40218

[21] Appl. No.: 652,224

[22] Filed: Sep. 4, 1984

[51] Int. Cl.[4] ..... F24F 7/10

[52] U.S. Cl. ..... 98/33.1; 98/36; 273/348; 273/410

[58] Field of Search ..... 98/31.5, 31.6, 33.1, 98/34.5, 34.6, 36; 273/348, 410

[56] References Cited

U.S. PATENT DOCUMENTS

| | | | |
|---|---|---|---|
| 2,196,400 | 4/1940 | Schwarzmayr | 98/33.1 |
| 2,310,414 | 2/1943 | Fritzam et al. | 98/33.1 |
| 3,585,919 | 6/1971 | Clifford | 98/33.1 |
| 4,114,521 | 9/1978 | Busch | 98/36 |
| 4,164,901 | 8/1979 | Everett | 98/31.5 |
| 4,484,563 | 11/1984 | Fritz et al. | 98/36 X |

FOREIGN PATENT DOCUMENTS

| | | | |
|---|---|---|---|
| 2260380 | 6/1974 | Fed. Rep. of Germany | 98/36 |
| 1226212 | 3/1971 | United Kingdom | 98/33.1 |

*Primary Examiner*—Harold Joyce

[57] ABSTRACT

An indoor gun firing range enclosure having an air supply plenum disposed at the uprange end wall of the enclosure and at least one air exhaust plenum located proximate the bullet trap located proximate the downrange end wall of the enclosure. The ceiling of the enclosure uniformly slopes downwardly from the uprange wall in a direction toward the downrange end wall of the enclosure. In an advantageous embodiment of the indoor gun firing range enclosure the air supply plenum is disposed at the intersection of the ceiling and uprange end wall and is designed to emit one-third of the air at an angle of approximately 45° to the vertical and the remaining two-third portion of air in a downwardly direction. In another advantageous embodiment of the indoor gun firing range enclosure the air supply plenum is located downrange from and in confronting relationship to the uprange end wall of the enclosure and includes a unique door arrangement to allow persons using the indoor range to pass through the air supply plenum to get from a spectators area behind the plenum to the shooting positions located in front of the air supply plenum, without extensive and dangerous blockage of the means of entry and egress from the spectator area to the shooting area.

8 Claims, 7 Drawing Figures

INDOOR GUN FIRING RANGE ENCLOSURE

BACKGROUND OF THE INVENTION

The present invention relates to buildings and more particularly to an indoor gun firing range enclosure.

Various designs for indoor gun firing range enclosures are known. However, they tend to be merely vacant rooms or buildings with minimum consideration given to ventilation air flow across the enclosure, and to the convenient passage for persons from a safe viewing area to shooting positions inside the enclosure.

SUMMARY OF THE INVENTION

The present invention recognizes these considerations and provides an enclosure especially for use as an indoor gun firing range.

More particularly, the present invention provides an indoor gun firing range comprising:

an enclosure having an uprange end wall, a downrange end wall spaced from and generally parallel to the uprange end wall, two spaced apart side walls interconnecting the uprange end wall and downrange end wall, a floor, and a ceiling having at least a portion sloping downwardly generally from the uprange end wall in a direction toward the downrange end wall;

gun shooting positions located a distance downrange from the uprange end wall;

a bullet trap located at the downrange end wall; and, an air circulation system for circulating air through the enclosure from the uprange end wall toward the downrange end wall comprising an air exhaust plenum open to the interior of the enclosure proximate the bullet trap and extending substantially completely across the width of the enclosure from one side wall to the other side wall of the enclosure for removing air from the enclosure, and an air supply plenum open to the interior of the enclosure at the uprange end wall and extending substantially completely across the width of the enclosure from one side wall to the other side wall of the enclosure for discharging air back into the enclosure.

BRIEF DESCRIPTION OF THE DRAWINGS

A better understanding of the present invention will be had upon reference to the accompanying drawings wherein like numerals refer to like parts throughout and in which.

DETAILED DESCRIPTION OF THE PREFERRED EMBODIMENT

Figure 1:
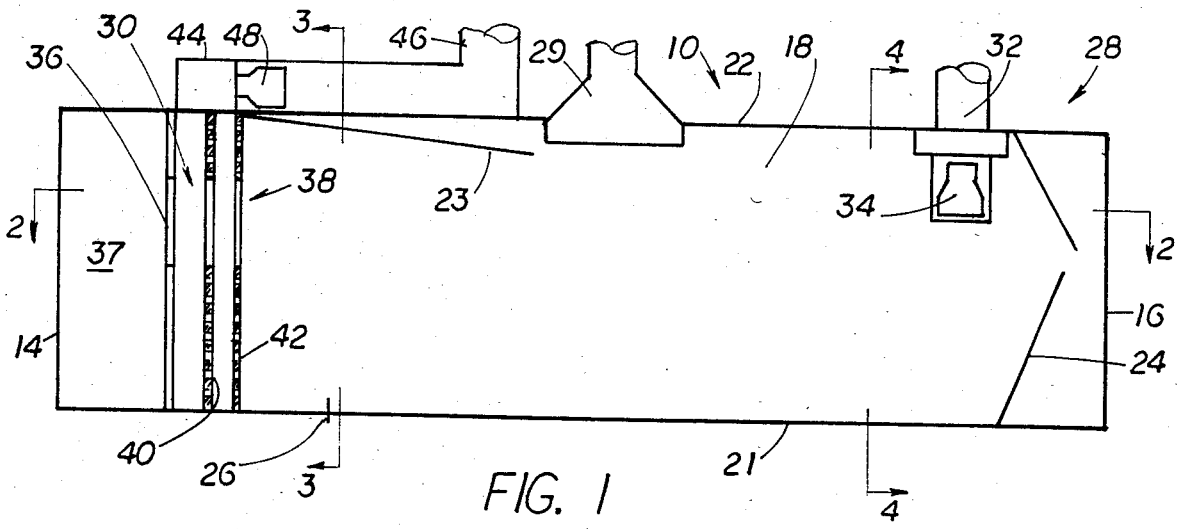
FIG. 1 is an elevational side view schematic representation of an indoor gun firing range enclosure of the present invention.

Referring first to FIGS. 1, 2, 3 and 4, there is illustrated an indoor gun firing range, generally denoted as the numer 10, which comprises an enclosure 12 having an uprange end wall 14, a downrange end wall 16 spaced from and parallel to the uprange end wall 14, two spaced apart side walls 18 and 20 interconnecting the uprange and downrange end walls 14 and 16, a floor 21, and a ceiling 22 over the tops of the walls.

The terms uprange and downrange as used herein define the relative position of the end walls and other components of the invention relative to the individual using the firing range. Ther term "uprange" refers to a location in back if the shooter or direction opposite to the direction in which the user of the range is shooting. The term "downrange" refers to a location in front of the shooter or in the direction in which the user of the range is shooting.

Typical of indoor firing ranges, the range 10 also has a bullet trap 24 located at the downrange end wall 16 to capture the bullet sluges, and a shooter's position or firing line 26 located a distance from the uprange end wall 14 whereat shooter's position themselves for firing their weapons at targets (not shown) located in front of or uprange of the bullet trap 24.

The enclosure 12 has an air circulation system for moving air across the enclosure 12 generally from the uprange end wall 14 toward the downrange end wall 16. This air circulation system comprises a first exhaust air plenum 28 open to the interior of the enclosure 12 and located proximate the bullet trap 24, and an air supply plenum 30 open to the interior of the enclosure and located at the uprange end wall 14.

The air exhaust plenum 28 extends substantially completely across the width of the enclosure from one side wall 18 to the other side wall 20 and is connected to an air duct 32. A plurality of preset constant volume air valves 34 are in the exhaust air plenum 28 at its opening into the enclosure 12 to maintain a constant volume of air flow into the exhaust air plenum as the air being exhausted from the enclosure may vary from time to time.

In practice it has been found satisfactory to size the exhaust air plenum to move various volumes, such as for example 15,000 cubic feet of air per minute with a velocity of about 630 feet per minute per linear foot of exhaust plenum across the width of the enclosure. This insures that a negative air pressure will be maintained with the firing range.

Figure 2:
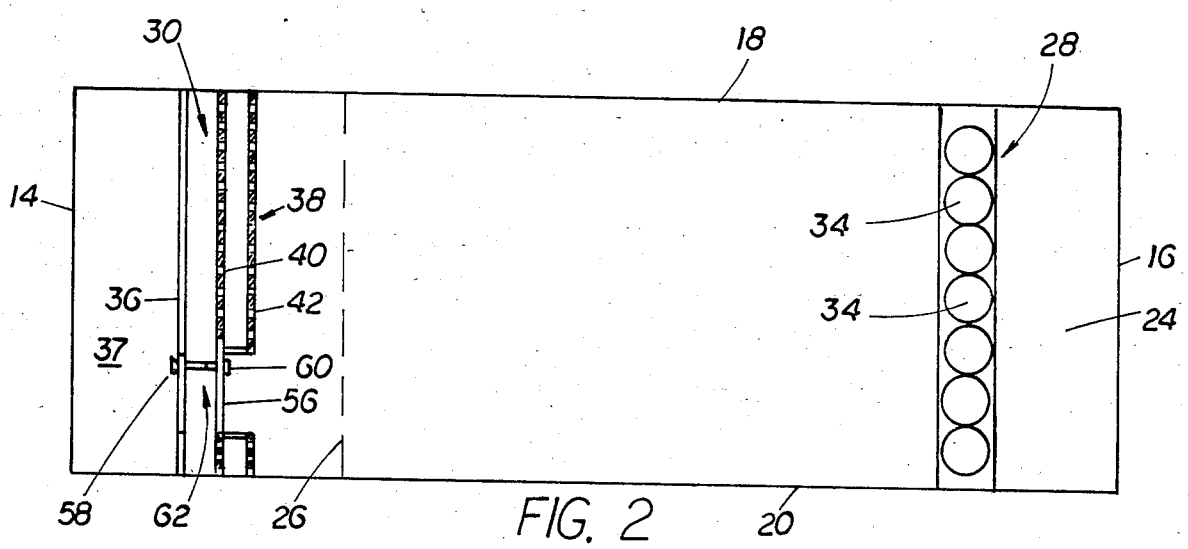
FIG. 2 is a plan view of the schematic representation of the indoor gun firing range enclosure of FIG. 1.
Figure 3:
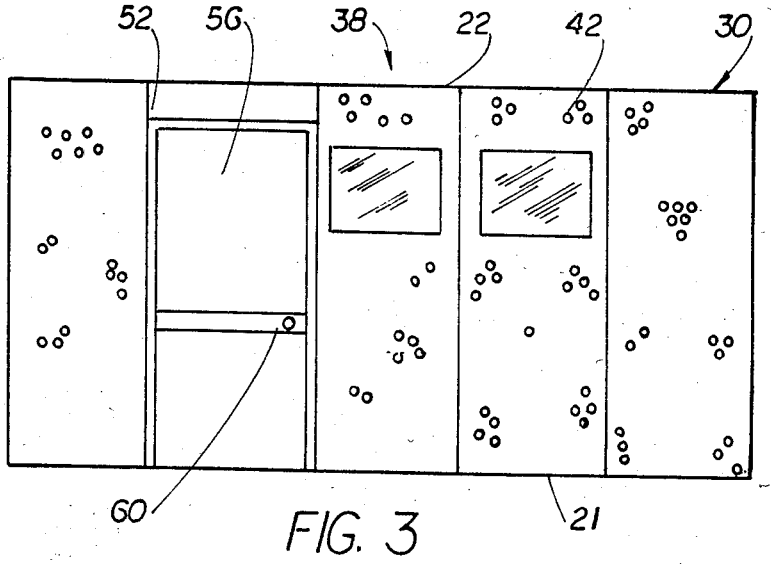
FIG. 3 is a transverse cross-sectional view taken in the direction of arrows 3—3 in FIG. 1.
Figure 4:
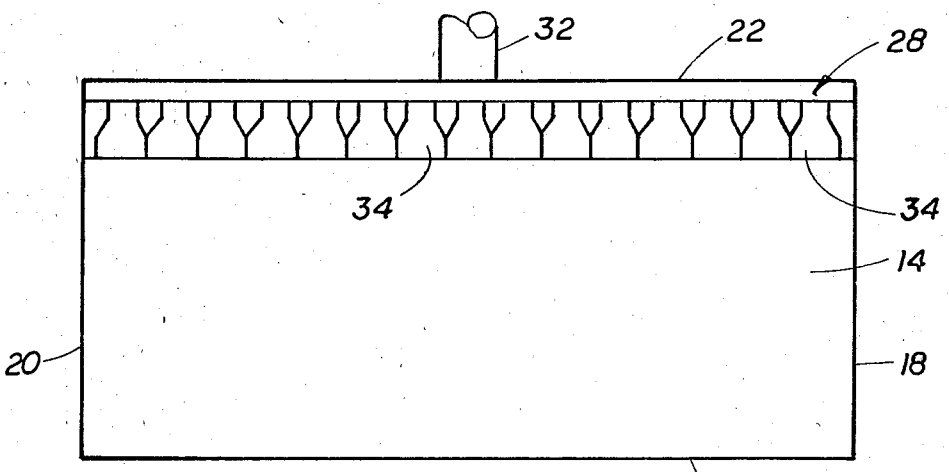
FIG. 4 is a transverse cross-sectional view taken in the direction of arrows 4—4 in FIG. 1.

FIGS. 1, 2 and 3 illustrates one advantageous embodiment of the air supply plenum 30 which comprises an air impervious wall structure 36 spaced from and generally parallel to the uprange end wall 14 and an air pervious diffusing wall structure 38 spaced downrange from and generally parallel to the air impervious wall structure 36, the air supply plenum 30 being defined between the air impervious wall structure 36 and the air pervious diffusing wall structure 38.

The area uprange of the air pervious wall structure 36, or between the uprange end wall 14 and air pervious wall structure 36 can be advantageously used as a safe spectators area 37.

The air impervious diffusing wall structure 38 comprises two spaced apart, generally parallel air pervious diffusing panels 40, 42. These panels 40, 42 can be constructed of perforated sheets.

In practice it has been found that perforations measuring about $\frac{1}{8}$ inches in diameter and on $\frac{3}{8}$ inches staggered centers works well. In addition, it is preferrable that the perforations in one of the panels 40 are mismatched with the perforations in the other panel 42, that is, the perforations in the panels 40 and 42 are not in alignment with each other.

Further, an air supply manifold 44 is in communication with the air supply plenum 30 for distributing air across the width of the air supply plenum and duct means 46 is in communication with the air supply manifold 44 for conveying air to the air supply manifold. A plurality of preset constant volume air valves 48 are disposed at the outlet from the manifold 44 to the air supply plenum to assure a constant volume of air to the air supply plenum 30 as the velocity and quantity of the supply air may vary from time-to-time with changing resistences in the filtration system.

In practice it has been found satisfactory to size the supply air to move a quantity of air, such as for example, 14,400 cubic feet per minute of air to the air supply plenum 30 and adjust the constant volume valves 48 to distribute this supply air at 600 cubic feet per minute per linear foot across the width of the air supply plenum. The perforations in the perforated panels 40, 42 are preferrably sized to provide a 0.10 water guage resistance to the flow of air through the air pervious diffusing wall structure 36. Under these conditions, the air velocity four feet downrange of the air pervious diffusing wall structure 36 will be 75 feet per minute.

With reference to FIG. 1, at least a portion 23 of the ceiling 22 slopes uniformly downwardly generally from the uprange wall structure 14 in a direction toward the downrange end wall structure 16. Again, in practice it has been found advantageous that the sloping portion 23 of the ceiling 22 have a uniform drop of one foot vertically over a horizontal distance of fourteen feet. Further, it has been found advantageous that the sloping portion 23 of the ceiling 22 terminate at a location downrange of the shooters position 26, preferrably about six feet downrange, and that the terminus of the sloping portion 23 be about eight feet above the floor 21 of the enclosure. A second air exhaust plenum 29 is located substantially immediately downrange of the terminus of the sloping portion 23 of the ceiling 22. The second exhaust plenum 29 is open to the interior of the enclosure.

Figure 5:
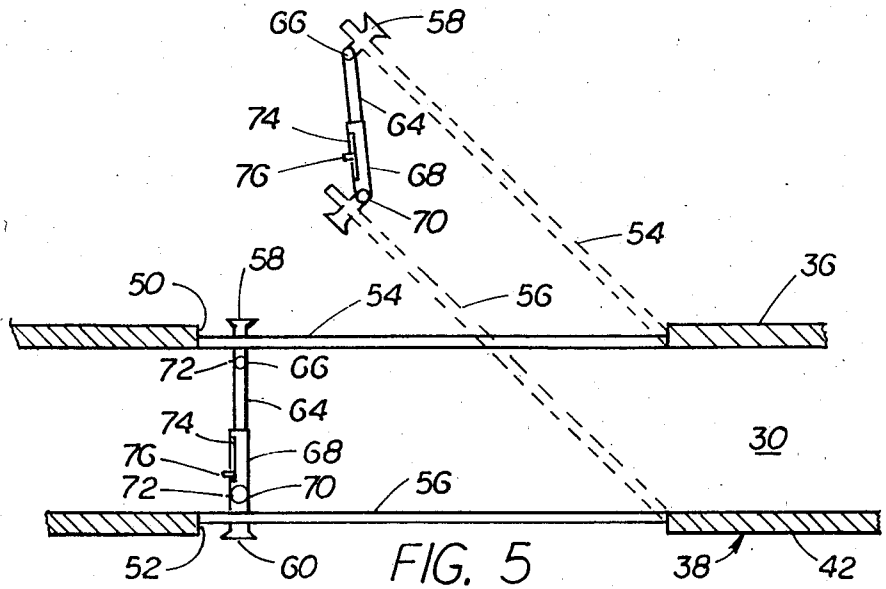
FIG. 5 is an enlarged cross-sectional view of the lower left corner area of FIG. 2 more clearly illustrating a component of the invention.
Figure 7:
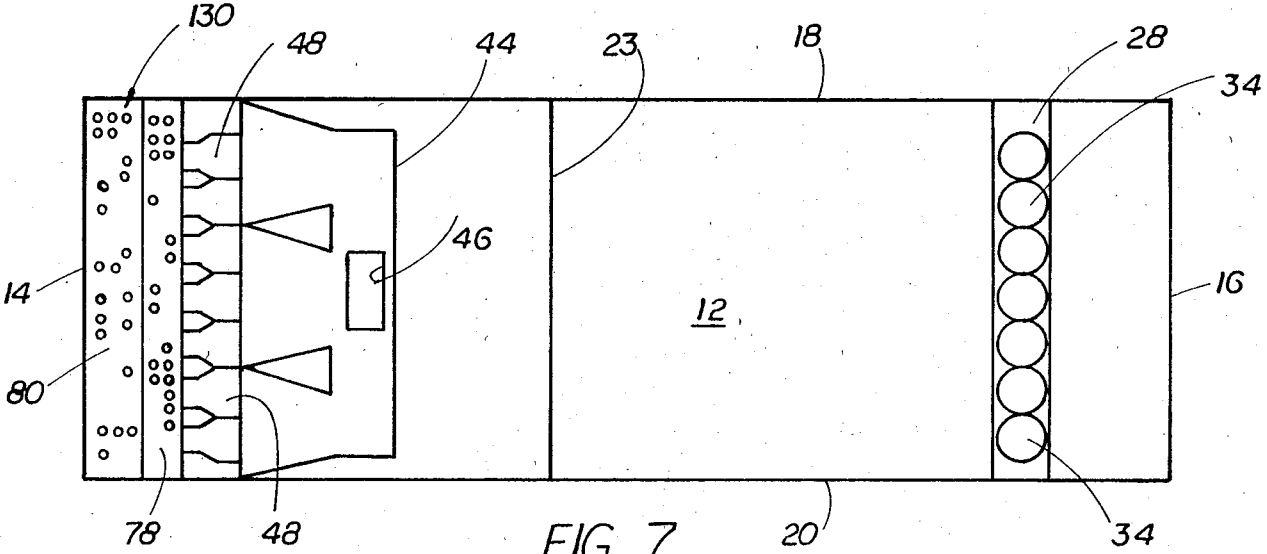

With particular reference to FIGS. 2, 3 and 5, a closeable passageway is provided through the air supply plenum 30 from the spectator area to the enclosure for the convenience of the shooters using the range. This closeable passageway comprises a first door opening 50 formed in the air impervious wall structure 36 and a second door opening 52 formed in the air pervious diffusing wall structure 38 in confronting alignment with the first door opening 50. A first door 54 is disposed in the first door opening 52 and hinged to the air impervious wall structure 36, and a second door 56 is disposed in the second door opening 52 and hinged to the air pervious diffusing wall structure 38. The first door 54 has latch means 58 to latch the first door 52 in a closed position covering the first door opening 50 and the second door 56 has latch means 60 to latch the second door 56 in a closed position covering the second door opening 52. The latch means 58 and 60 can be virtually any conventional type latch, and therefore will not be further discussed. With continued reference to FIGS. 2 and 3, but with particular attention to FIG. 5, means, generally denoted as the numeral 62, interconnects the first door latch means 58 and second door latch means 60 so that as one of the door latch means 58 or 60 is manually unlatched the other door latch means 58 or 60 is automatically and concurrently unlatched. This interconnecting means 62 comprises a telescoping tube structure having a first tube section 64 pivotally connected at one of its ends 66 to the first door latch means 58 and a second tube section 68 telescopically received in the first tube section 64 and pivotally connected at one of its ends 70 to the second door latch means 60. The pivotal connections of the ends 66 and 70 of the telescoping tube structure 62 to the first and second door latch means 58 and 60, respectively, allow the tube structure 62 to pivotally move relative to the first and second doors in a plane perpendicular to the planes of the doors or hinge axes of the doors as the doors pivot about their hinges between open and closed positions. The pivotal connection of the ends 66 and 70 of the telescoping tube structure 62 comprises a pin connection 72 to the latch means 58 and 60 so that as one of the latch means is turned between an unlatched and latch position the telescoping tube structure will turn with the latch means 58 and 60 about the longitudinal axes of the telescoping tube structure 62 and impart a like turning motion to the other latch means. The telescoping tube structure 62 also includes stop means for preventing the first and second tube sections 64, 68 from telescopically separating. This stop means comprises an elongated slot 76 formed in the wall of the first tube section 64 subsantially parallel to the longitudinal axes of the first tube section and a pin 76 projecting radially from the second tube section 68 and received in the elongated slot 74 with enough clearance to allow the pin 76 to freely translate along the elongated slot as the first and second tube sections telescopically move.

In operation, as one of the latch means, for example the first latch means 58, is manually turned to unlatch the first door 54 the telescoping tube structure 62 turns with the first latch means and imparts alike unlatching turning motion to the second latch means 60. The first door 54 is then pushed from a closed position over the first door opening 50 (solid lines in firgure 5) to an open position (dashed lines in FIG. 5). The movement of the first door 50 is imparted to the second door 52 by the telescoping tube structure 62 causing the second door to concurrently move from its closed position over the second door opening 52 (solid lines in FIG. 5) to an open position (dashed lines in FIG. 5). With reference to the broken arced lines in FIG. 5 which indicated the path of the first and second doors as they move between an open position and closed position, it will be noticed that the distance between the doors changes. The telescoping motion of the tubular structure 62 and the pivotal attachment of the ends of the telescoping tube structure 62 to the door latch means accommodates this changing distance between the doors. Further, it will be noticed that the first and second doors are in spaced apart parallel relationship when they are in the closed positions, but that they are in an overlapping, offset, contiguous relationship when in the fully open position. Again the telescoping motion of the tubular structure 62 and the pivotal attachment of the ends of the telescoping tube structure 62 to the door latch means accommodates the changing relationship between the first and second doors as they move between their open and closed positions.

As can be seen in FIG. 3, the second door 56 is advantageously formed of an air pervious diffusing material such as a perforated panel so that when it is in a closed position covering the second door opening air will exit the air supply plenum and into the enclosure in a diffused distributed flow corresponding to the air flow through the perforated panels 40, 42 which comprise the air pervious diffusing wall structure 38.

The first door 54 is fabricated of an air impervious material so that when it is in a closed position covering the first door opening 50 it cooperates with the air impervious wall structure 36 to prevent supply air from flowing out of the air supply plenum except through the air pervious diffusing wall structure 38.

Figure 6:
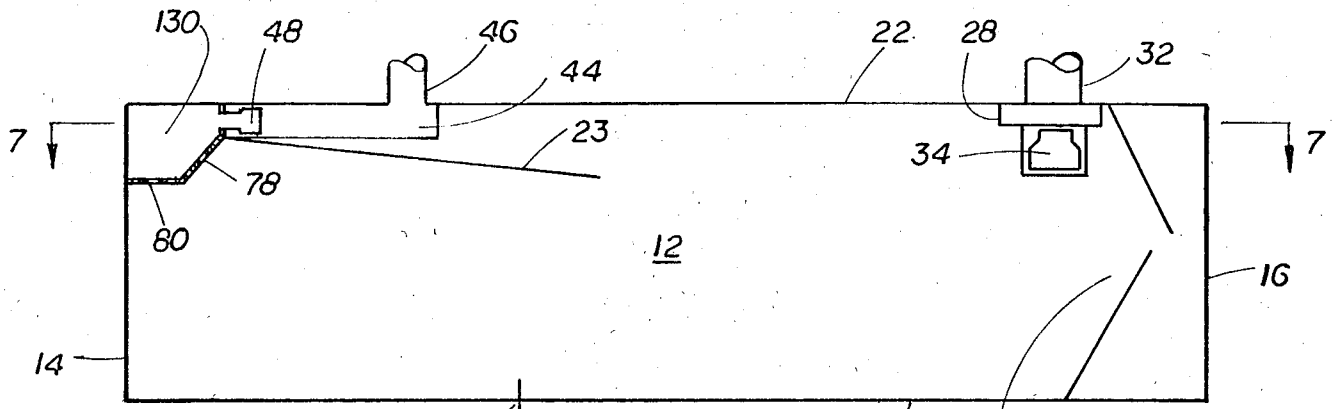
FIG. 6 illustrates another advantageous embodiment of a component of the present invention; and, FIG. 7 illustrates a view taken in the direction of arrows 7—7 in FIG. 6.

FIG. 6 illustrates another embodiment of the air supply plenum chamber, in this instance denoted as the numeral 130, which is located at the intersection of the enclosure ceiling 22 and uprange end wall 14. This air supply plenum 130 extends substantially completely across the width of the enclosure from one side wall 18 to the other side wall 20. The air supply plenum 130 is comprised of two air pervious diffusing panels 78 and 80 which serve to diffuse and distribute the air flowing from the air supply plenum 130 into the enclosure. One of the air pervious panels, for example panel 78, is oriented at approximately a 45° angle to the vertical and the other air pervious panel 80 is horizontally oriented and is disposed adjacent to the panel 78. The air supply duct means 46, through the air supply manifold 44 discharges supply air into the air supply plenum 130. A one-third portion of this air flows out of the air supply plenum 130 through the air pervious diffusing panel 78 at an angle of approximately 45° to the vertical in the general direction of the shooter positions 26, and the remaining two-thirds portion of the air flows out of the plenum chamber 130 through the air pervious diffusing panel 80 in a downwardly direction. These two air flows from the air supply plenum 130 are caused to turn to a horizontal flow direction as it flows toward the air exhaust plenum 28 located downrange of the air supply plenum 130 so that the air flow across the firing positions 26 is horizontal to sweep the contaminates produced by the firing of a gun away from the shooter.

The foregoing detailed description is given primarily for clarity of understanding and no unnecessary limitations should be understood therefrom, for modifications will be obvious to those skilled in the art and may be made without departing from the spirit of the invention or the scope of the appended claims.

What is claimed is:

1. An indoor gun firing range comprising:

an enclosure having an uprange end wall, a downrange end wall spaced from and generally parallel to the uprange end wall, two spaced apart side walls interconnecting the uprange wall and downrange wall, a floor, and a ceiling having at least a portion sloping downwardly generally from the uprange end wall in a direction toward the downrange end wall;

gun shooting positions located a distance from the uprange end wall;

a bullet trap located at the downrange end wall; and, an air circulation system for circulating air through the enclosure generally from the uprange end wall toward the downrange end wall comprising at least one air exhaust plenum open to the interior of the enclosure proximate the bullet trap and extending substantially completely across the width of the enclosure from one side wall to the other side wall of the enclosure for removing air from the enclosure, and an air supply plenum open to the interior of the enclosure at the uprange end wall, the air supply plenum being located substantially at the intersection of the ceiling and the uprange end wall of the enclosure and extending substantially completely across the width of the enclosure from one side wall to the other side wall, the air supply plenum having a first air pervious diffusing wall oriented at approximately 45° to the vertical to discharge air at and angle from the intersection of the ceiling and uprange end wall, and a second air pervious diffusing wall horizontally oriented and extending from the first air pervious diffusing wall to the uprange end wall of the enclosure to discharge air vertically downwardly therefrom.

2. The indoor gun firing range of claim 1, wherein the ceiling drops uniformly one foot vertically over a horiztonal distance of fourteen feet.

3. The indoor gun firing range of claim 2 wherein the ceiling terminates its downward slope at a location between the gun shooting positions and the bullet trap.

4. The indoor gun firing range of claim 3, wherein the terminus of the sloping portion of the ceiling is approximately eight feet above the floor of the enclosure.

5. The indoor gun firing range of claim 4, wherein the terminus of the sloping portion of the ceiling is approximately six feet downrange of the gun shooting positions.

6. The indoor firing range of claim 3, further comprising a second air exhaust plenum open to the interior of the enclosure substantially immediately downrange of the terminus of the sloping ceiling.

7. The indoor gun firing range of claim 6, further comprising:

an air supply manifold in communication with the air supply plenum for distributing air across the width of the air supply plenum;

duct means in communication with the air supply manifold for conveying air to the air supply manifold; and, a plurality of preset constant volume air valves disposed at the outlet of the manifold to the air supply plenum to assure a constant volume of air to the air supply plenum as the velocity of the supply air may vary from time-to-time.

8. The indoor gun firing range of claim 7 wherein:

the air exhaust plenum is located at the ceiling of the enclosure and comprises a plurality of preset constant volume air valves disposed at the air exhaust plenum opening to the enclosure to assure a constant volume of air flow into the velocity of the air being exhausted from the enclosure may vary from time-to-time.

* * * * *